United States Patent [19]

Bates

[11] 4,138,848

[45] Feb. 13, 1979

[54] COMPRESSOR-EXPANDER APPARATUS

[76] Inventor: Kenneth C. Bates, 28 Scenic Dr., Poughkeepsie, N.Y. 12603

[21] Appl. No.: 754,508

[22] Filed: Dec. 27, 1976

[51] Int. Cl.[2] ..... F02G 1/04; F25D 9/00; F01C 1/20; F01C 19/04

[52] U.S. Cl. ..... 60/519; 62/402; 418/9; 418/122; 418/191

[58] Field of Search ..... 418/9, 120–123, 418/191, 205, 206; 62/402; 60/519

[56] References Cited

U.S. PATENT DOCUMENTS

| | | | |
|---|---|---|---|
| 103,482 | 5/1870 | McIlwain et al. | 418/206 |
| 664,480 | 12/1900 | Ibach | 418/121 |
| 725,028 | 4/1903 | Bottcher et al. | 418/191 |
| 1,292,324 | 1/1919 | Inshaw | 418/121 |
| 1,440,000 | 12/1922 | Bonine | 62/402 |
| 1,704,938 | 3/1929 | Gardes | 418/191 |
| 2,164,462 | 7/1939 | Lutschg | 418/191 |
| 3,188,822 | 6/1965 | Daunt | 60/526 |
| 3,426,525 | 2/1969 | Rubin | 60/519 |
| 3,472,445 | 10/1969 | Brown | 418/191 |
| 3,612,735 | 10/1971 | Graham | 418/191 |
| 3,860,366 | 1/1975 | Haglund et al. | 418/122 |

FOREIGN PATENT DOCUMENTS

| | | | |
|---|---|---|---|
| 734691 | 8/1943 | Fed. Rep. of Germany | 418/191 |
| 2159274 | 6/1973 | Fed. Rep. of Germany | 60/519 |

*Primary Examiner*—John J. Vrablik

[57] ABSTRACT

A single rotary fluid unit can act either as a compressor or as an expander. Each unit has a casing enclosing two rotors moved in synchronism. The rotors sealingly engage and coact with each other and the casing walls to form chambers providing the necessary intake and exhaust functions. Two units can be connected together to operate in a mirror-like or reverse fashion whereby one unit is a compressor and the other unit is an expander. The thus formed compressor-expander units or apparatus can be connected to additional apparatus to form a Stirling cycle engine or an air cycle refrigeration apparatus.

11 Claims, 24 Drawing Figures

COMPRESSOR-EXPANDER APPARATUS

RELATED PATENT APPLICATION

Reference is here-made to my related application Ser. No. 615,362, filed Sept. 22, 1975, now U.S. Pat. No. 4,086,880, for "Rotary Prime Mover and Compressor and Methods of Operation Thereof".

SUMMARY OF THE INVENTION

One of the objects of the invention is to provide a combined expander and compressor apparatus that operates primarily with rotary motion without any reciprocating, orbital, planetary or eccentric motion.

Another object is to provide a high efficiency expander compressor apparatus wherein at least some of the energy transferred to compressed fluid during the compression cycle is returned to the system during the expansion cycle.

A further object is to provide a unit that can be operated as a compressor or as an expander, which unit is an improvement over apparatus described in the above related application, the improvement being advantageous in achieving higher efficiency when operated as an expander or compressor, as opposed to being used as an internal combustion engine.

Still another object is to provide an expander-compressor apparatus wherein fluid flows between the expander and compressor units, there being a continuous flow from the expander unit.

Another object is to provide an expander-compressor unit that can be readily combined with further apparatus to form a Stirling cycle engine.

A still further object is to provide an expander-compressor apparatus that can be combined with further apparatus to form an air cycle refrigeration system.

Another object is to provide a novel sealing means which coacts between the apex of a rotor and a casing to provide a sliding seal therebetween, the sealing means being intermittently engaged with the casing.

Other objects and advantages of the invention will be apparent from the following detailed description taken in connection with the accompanying drawings wherein.

Figure 1:
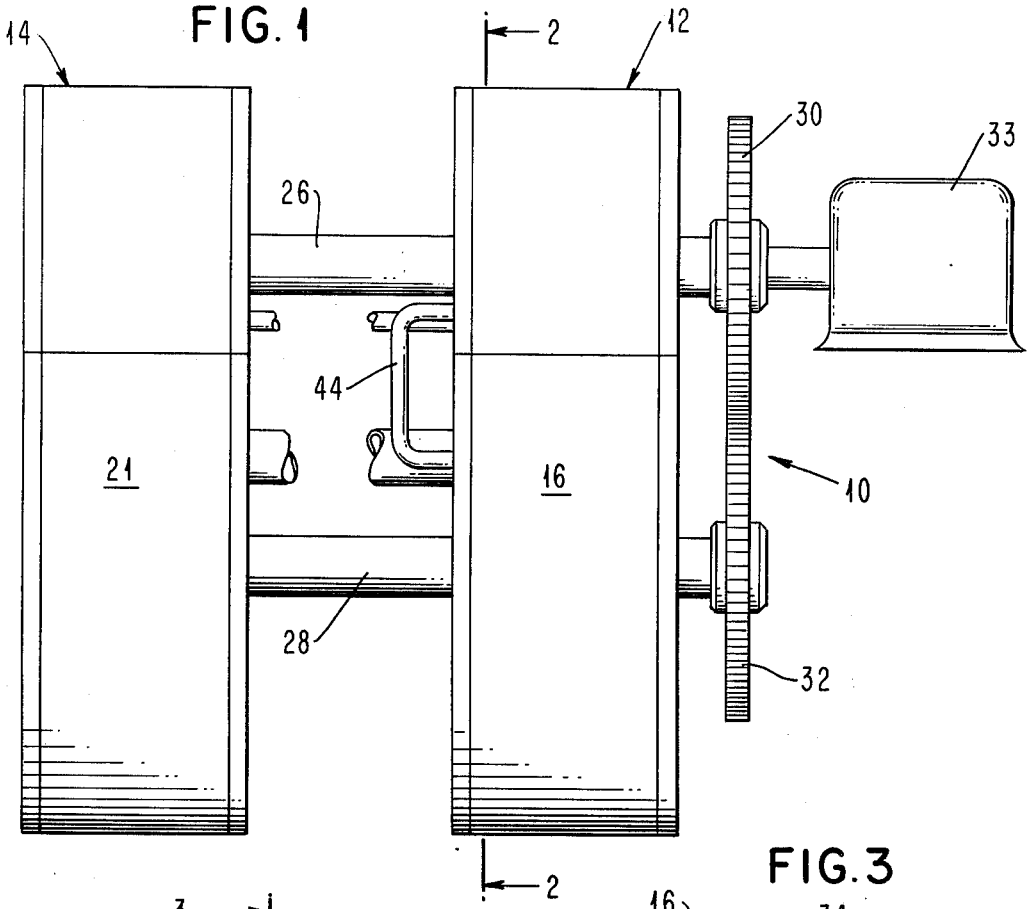
FIG. 1 is a partly schematic side elevational view of apparatus embodying the invention.

Referring now to the drawings and first to FIG. 1, the invention there shown is an expander-compressor apparatus 10 having a compressor unit 12 and an expander unit 14. Compressor unit (CU) 12 comprises a casing 16 enclosing two rotors 18 and 20. Expander unit (EU) 14 comprises a casing 21 enclosing two cylindrical rotors 22 and 24. CU12 and EU14 are mirror images of one another and are operated synchronously so that while CU 12 is compressing fluid, EU 14 allows fluid to expand, as described in more detail below. Rotors 18 and 22 are mounted on a common shaft 26 and rotors 20 and 24 are mounted on a common shaft 28. Identical spur gears 30 and 32 are mounted on adjacent ends of shafts 26 and 28 and synchronize rotation thereof. Shaft 26 is further connected to a rotary motor 33.

Figure 2:
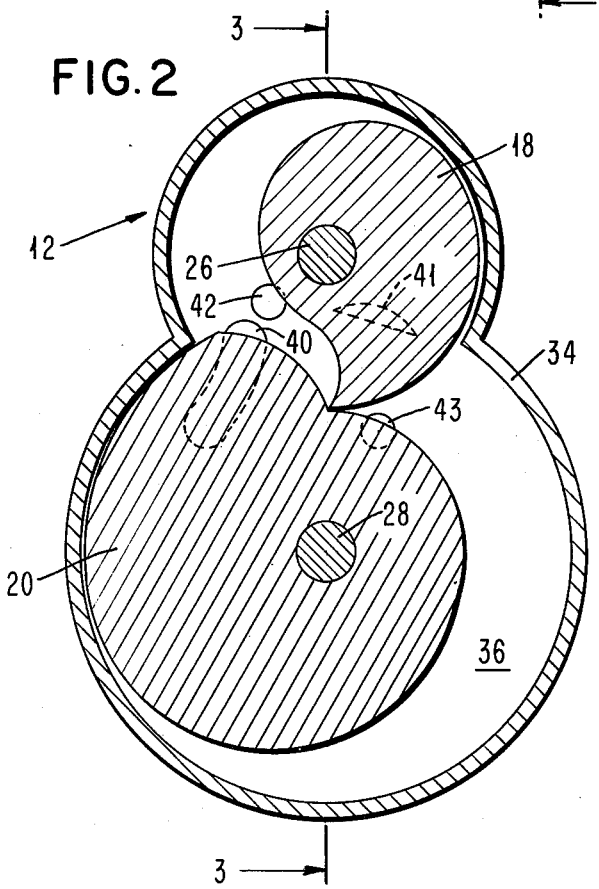
FIG. 2 is a cross-sectional view through the compressor unit looking along reference lines 2—2 of FIG. 1.
Figure 3:
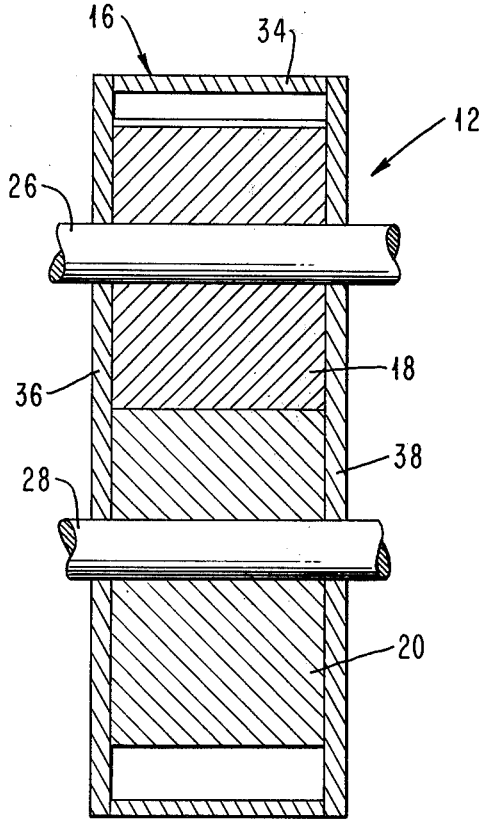
FIG. 3 is a longitudinal sectional view through the compressor unit looking along reference lines 3—3 of FIG. 2.
Figure 4:
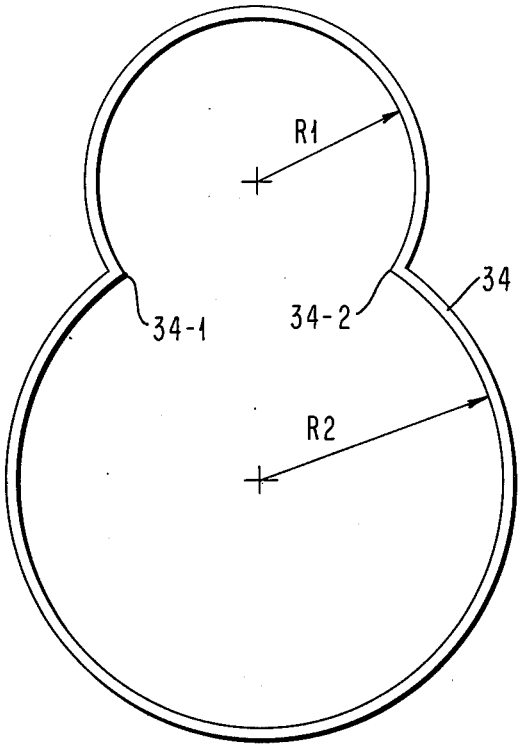
FIG. 4 is a front elevational view of the compressor casing side wall.
Figure 5:
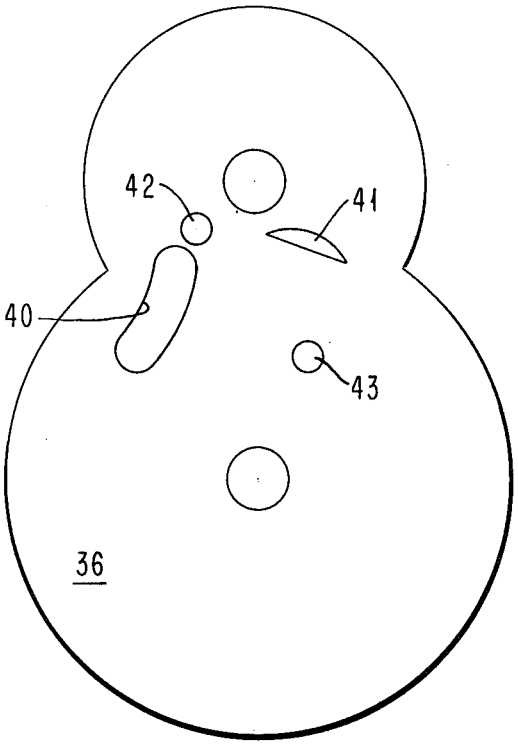
FIG. 5 is a front elevational view of an end wall of the compressor.

As best seen in FIGS. 2 and 3, casing 16 is cylindrical and has a central side wall 34 and two end walls 36 and 38 joined together in any conventional suitable manner such as by bolts (not shown) to form a rigid casing. End wall 36 has openings therein forming an inlet or intake port 40, an outlet or exhaust port 41, and bypass ports 42 and 43. Side wall 34 is formed of two portions having different internal radii R1 and R2 (FIG. 4) so that the interior of casing 16 comprises two parallel intersecting cylindrical chambers of segmental shaped radial section within which rotors 18 and 20 are disposed. The inner surfaces join at apexes 34-1 and 34-2 form a rectangular opening.

Figure 6:
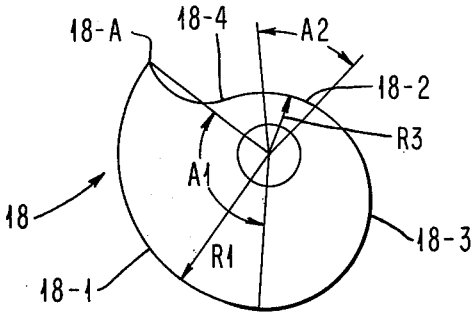
FIGS. 6 and 7 are plan views of rotors used in the compressor unit.

As shown in FIG. 6, rotor 18 has an outer radial surface comprising four portions or sections 18-1–18-4 of differing radial characteristics. Portion 18-1 subtends an arc of angle A1 and is of a constant radius R1 that is nominally the same as R1 in FIG. 4 but, in reality, would be slightly less to provide suitable running clearance. Portion 18-2 subtends an arc of angle A2 and has a constant radius R3 less than R1. Portion 18-3 extends between section 18-1 and 18-2 and is of a volute shape with a non-constant radius decreasing from R1 to R3. Portion 18-4 has a volute shape and is opposite to 18-3 and extends between the other ends of portions 18-1 and 18-3. Sections 18-1 and 18-4 intersect and form an apex 18-A.

Figure 7:
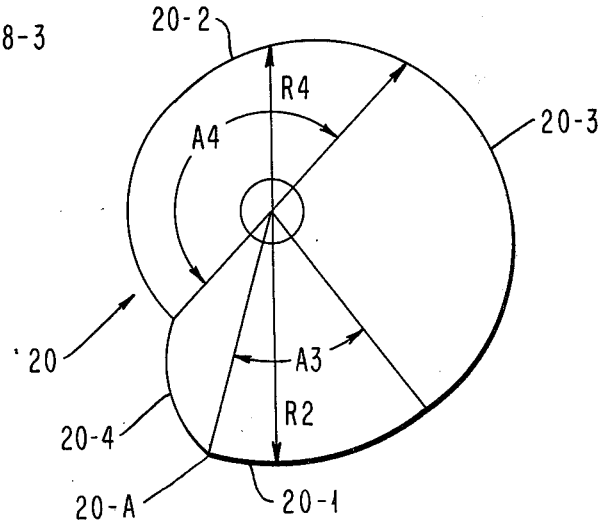

As shown in FIG. 7, rotor 20 has an outer radial surface comprising portions 20-1–20-4. Portions 20-1 and 20-2 are opposed or angularly spaced from each other and are of constant radii R2 and R2 respectively. R2 is nominally the same as R2 (FIG. 4) but would have a dimension slightly less to provide suitable running clearance. Portions 20-3 and 20-4 are volute shaped and extend respectively between portions 20-1 and 20-2 as shown. Sections 20-1 and 20-4 intersect to form an apex 20-A.

The operation of CU12 is best explained by reference to FIGS. 8–12 which show successive positions during one synchronized revolution of rotors 18 and 20. Beginning with FIG. 8, rotors 18 and 20 have just completed one compression cycle and are at the start of another. In the positions shown in FIG. 8, rotors 18 and 20 interact with casing 16 to form two chambers C1 and C2. Chamber C1 is open to inlet 40 and bypass 42. Chamber C2 is open to bypass port 43 which is almost completely covered. As the rotors rotate in the direction of the arrows from this position, chamber C1 increases in volume thus allowing more fluid to enter the compressor and chamber C2 decreases in volume at a rate less than the rate of expansion of chamber C1. A tube 44 (FIG. 1) connects ports 42 and 43 and tends to equalize the pressures in the respective chambers until ports 42 and 43 are closed.

Figure 8:
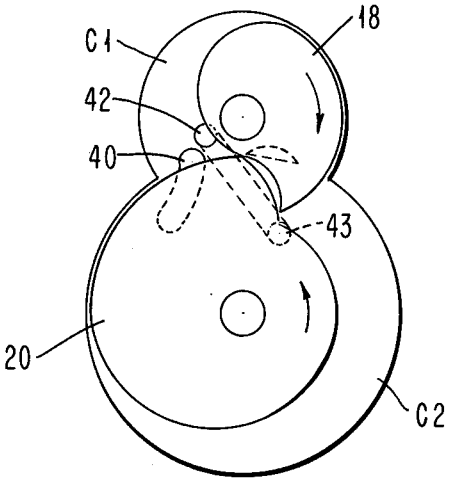
FIGS. 8–12 are schematic views of successive positions of the compressor unit rotors useful in explaining and understanding the operation of the compressor unit.
Figure 9:
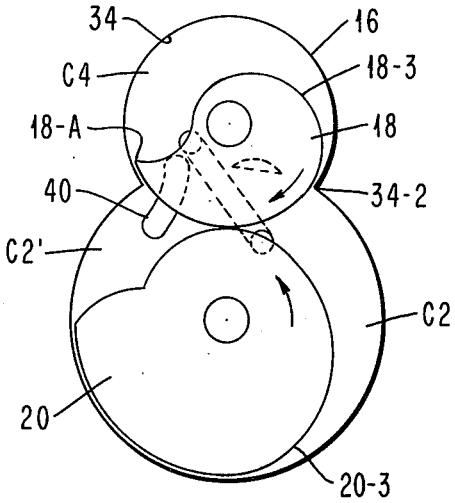

As the rotors move from the positions shown in FIG. 8, apex or tip 18A moves into a sealing position against the inner wall of side wall 34, and chamber C1 (FIG. 8) is divided into two chambers C2′ and C4 (FIG. 9). Further rotation moves rotors 18 and 20 to the positions shown in FIG. 9 wherein chamber C4 is cutoff from inlet 40. Chamber C4 is of a fixed volume and communicates with chamber C2 through bypass ports 42 and 43 so that the pressure in C4 tends to equalize with that of C2. Chamber C2′ communicates with inlet 40 whereby further rotation draws fluid into C2′ as it increases or expands in volume. This intake continues until inlet 40 is covered or cutoff from C2′ by rotor 20. Shortly after chamber C4 is formed, further rotation of rotor 18 causes volute portion 18-3 to pass point 34-2 thereby causing chambers C4 and C2 to open into one another and form a new chamber C5 (FIG. 10) in which further compression takes place. Upon forming chamber C5, the pressure equalizes and bypasses 42 and 43 are cutoff.

Figure 10:
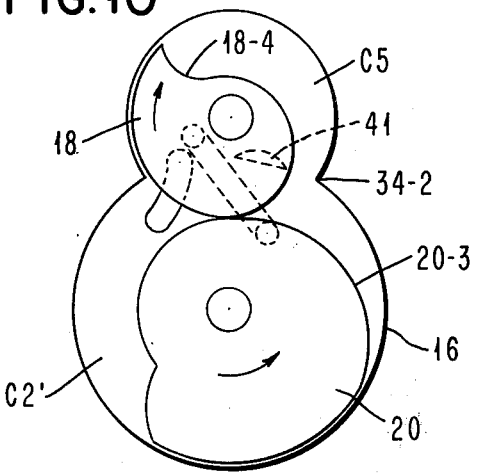
Figure 11:
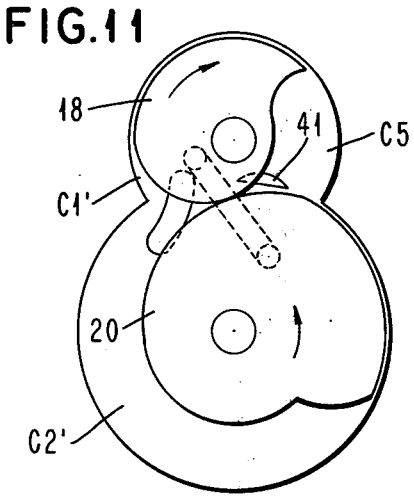

Further rotation causes the rotors to pass through the positions shown in FIG. 10 wherein rotor 18 is about to start uncovering outlet 41 allowing compressed fluid to flow from chamber C5 therethrough. Concurrently, chamber C2′ continues to intake new fluid. It should be noted that in the positions shown in FIG. 11, chamber C5 is defined predominantly by rotor 18 whereby continuing movement of rotor 18 is the primary cause for compressing the fluid in chamber C5. As rotor 18 and 20 move from the positions in FIG. 11 towards those in FIG. 12, a new chamber C1′ is formed that communicates with inlet 40, constant radius sections 20-1 and 18-2 engage one another, and chamber C2′ is cut-off from inlet 40.

Figure 12:
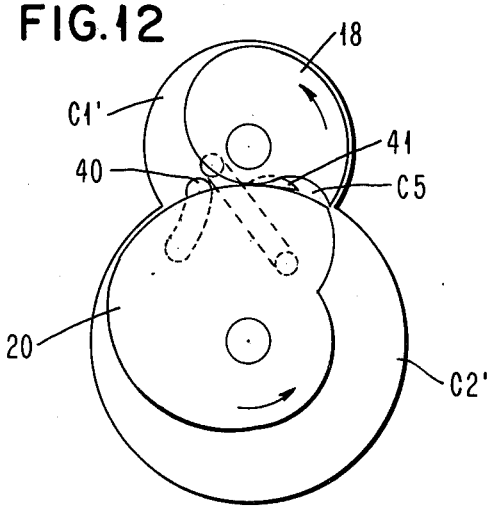

Continued rotation brings the rotors to the positions shown in FIG. 12 wherein chamber C5 is a pocket between volute portion 18-4 and constant radius portion 20-1. In the positions shown in FIG. 12, apexs 20-A, 18-A and 34-2 are coincident. This relationship is important since it establishes the basis whereby the volume of chamber C5 is eventually reduced to zero. Continued rotation causes apex 20-A to sweep along the volute portion 18-4 to reduce the volume of chamber C5 to zero while expelling all fluid out through outlet 41. Thereafter, the rotors move into the position shown in FIG. 8 to begin another cycle. In the transition, chambers C1′ and C2′ become chambers C1 and C2.

In summary of the operation of the compressor, rotors 18 and 20 coact with each other and with casing 16 to perform the functions of intake, compression and exhaustion on the fluid compressed thereby. The operation has several advantages, the principal one being that such functions are accomplished with only rotary movement, there being no reciprocating movement or parts. However, as noted below, there may be some reciprocation of the seals as described hereinafter. Additionally, there is a positive movement of substantially all fluid that enters the unit completely through the unit, with no "dead" compression zones.

Figure 13:
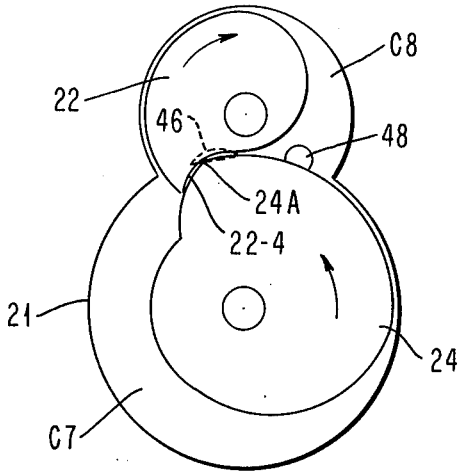
FIGS. 13–18 are schematic views of successive positions of the expander unit rotors useful in explaining and understanding the operation of the expander unit.

ER14 is a substantially mirror image of CU12 in both structure and operation with the exception that rotors 22 and 24 are angularly advanced relative to the position of rotors 18 and 20, the advance being such that when rotors 18 and 20 are positioned as in FIG. 12 at the start of the final phase of compression of sweeping through the pocket, rotors 22 and 24 are positioned as shown in FIG. 13. Casing 21 is similar to casing 16 except that the functions of the ports are reversed and port 46 is an intake port or inlet and port 48 is an exhaust port or outlet. Rotors 22 and 24 are shaped the same as rotors 18 and 20 but rotate in the opposite or reverse directions. Because of the similarity, the following description of the operation will not go into the details discussed above, it being felt that such details are obvious to persons skilled in the art.

As shown in FIG. 13, the positions of rotors 22 and 24 correspond substantially to the positions that rotors 18 and 20 occupy in FIG. 12. As seen in FIG. 13, rotors 22–24 and casing 21 form two chambers C7 and C8. Chamber C8 communicates with outlet 48 so that expanded fluid exhausts from chamber C8 therethrough. Chamber C7 has already received some relatively high pressure fluid and is in the process of increasing in volume. Apex 24-A is sliding along volute portion 22-4 having passed through a position of zero volume. Inlet 46 is being uncovered to admit high pressure compressed fluid into a high pressure pocket C9 (FIG. 14).

Figure 14:
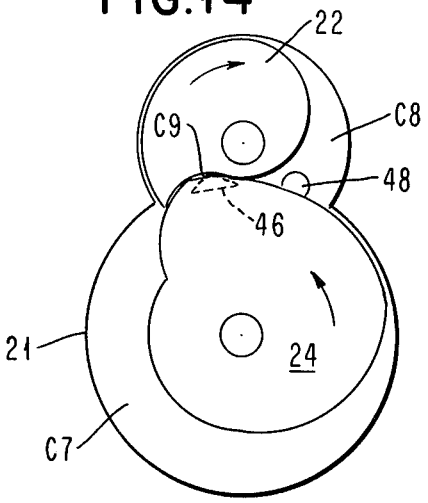

Upon further rotation, the rotors pass through the positions shown in FIG. 14 wherein the expanding high pressure pocket or chamber C9 receives compressed fluid. Further rotation moves the rotors to the positions shown in FIG. 15, and chamber C9 increases in volume and remains open to inlet 46 to receive additional fluid. Chamber C7 assumes a temporary constant volume and chamber C8 decreases in volume to further exhaust gas out of outlet 48. It should be noted that because the fluid in chamber C9 is at a higher pressure than the fluid in chamber C8, a force is created that acts on rotor 22 tending to rotate it in the direction of rotation. In other words, throughout this portion of the cycle, some of the energy that was used to initially compress the fluid is being returned to the system to thereby increase the efficiency of operation. A similar action takes place relative to rotor 24 wherein the higher pressure in C9 (FIG. 16) creates a force that pushes rotor 24 in the direction of rotation.

Figure 15:
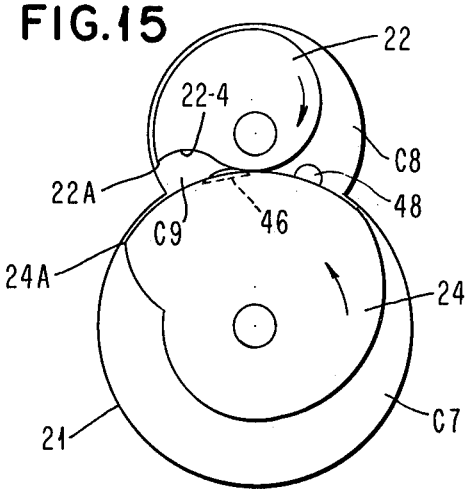
Figure 16:
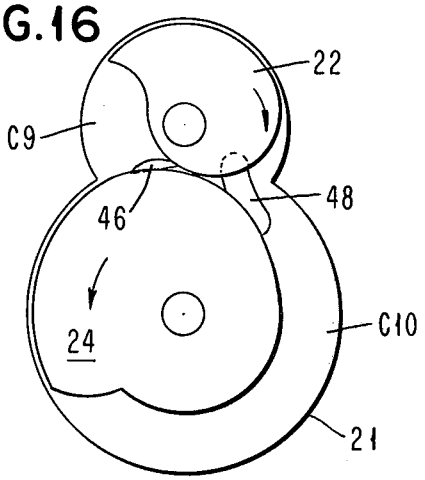
Figure 17:
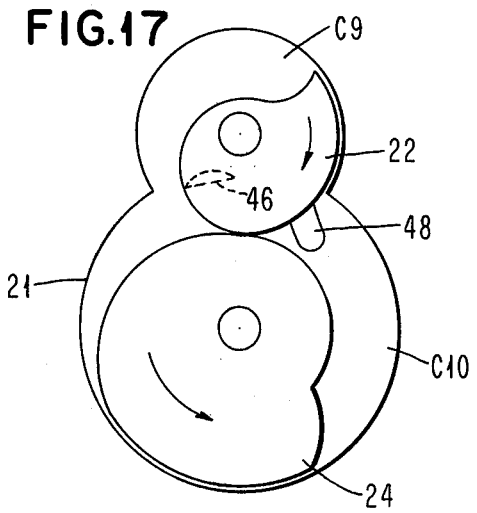
Figure 18:
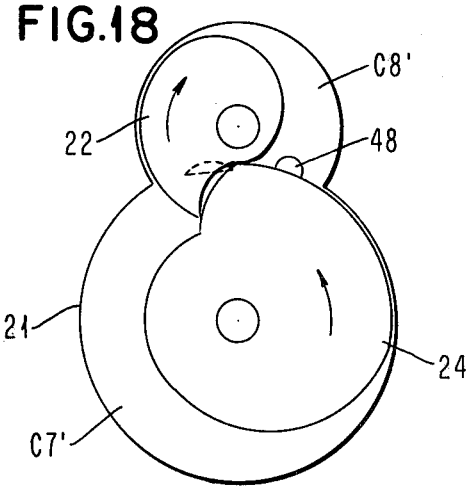

As the rotors move from the positions in FIG. 15, chambers C7 and C8 are merged to form a new chamber C10 (FIG. 16). Chamber C9 enlarges and receives more compressed fluid until as shown in FIG. 17, inlet 46 is covered to cut-off further intake of compressed fluid. On further rotation, fluid in chamber C10 continues to exhaust and C10 reduces in volume. When section 22-1 meets apex 34-1, chamber C9 is divided into new chambers C7′ and C8′ which, upon completion of one cycle, become chambers C7 and C8 in FIG. 13. It should be noted that outlet 48 is shaped and located so as to be open through the entire cycle to provide a continuous flow of expanded fluid. In the position shown in FIG. 18, apex 24-A is at the zero volume position of the high pressure pocket about to be formed.

In relation to the above related application, the invention disclosed herein differs in the following aspects. The related invention is oriented primarily towards an internal combustion engine and, to this end, the rotors are shaped to form two chambers during each cycle, a combustion chamber and a precombustion chamber. The present invention eliminates the equivalent of the precombustion chamber and thus achieves a higher compression efficiency and avoids any wasted compression volume. Additionally, in the related invention, if used as an expander, there is a sharp or abrupt change in the torque output whereas, in the present invention, there is a smooth simultaneous torque development on both shafts. Also, the present invention produces a continuous flow of expanded gases whereas the related invention produces an intermittent flow.

It should be noted that rotor surfaces 18-4 and 20-3 of CU12 act as vanes or pistons to compress the fluid in front thereof against the respective other rotor. Such surfaces are located in front of or lead apexes 18-A and 20-A in the direction of rotation. Surface 20-3 compresses the fluid in chamber C2 (FIG. 9) and both surfaces 18-4 and 20-3 compress the fluid in chamber C5 with both pistons reacting against each other to compress the fluid. In the final compression phase (FIG. 12), surfaces 18-4 and 20-1 form the reaction surfaces for compressing the fluid. In EU14, the piston or vanes trail movement of apexes 22-A and 24-A (FIG. 15) and are formed by volute surfaces 22-4 and 24-3 against which the fluid pressure acts to impart energy to the rotors.

It should be obvious that the relative inner dimensions of the casings and outer dimension of the rotors and the positions of the ports establish the relative compression and expansion ratios and such dimensions and locations can be selected as desired to suit the particular application. Additional units may be connected together as desired. For example, there might be three compressor units to one expander unit wherein the latter unit is effectively three times as large as the former. Other variations with their resultant characteristics should be obvious.

Figure 19:
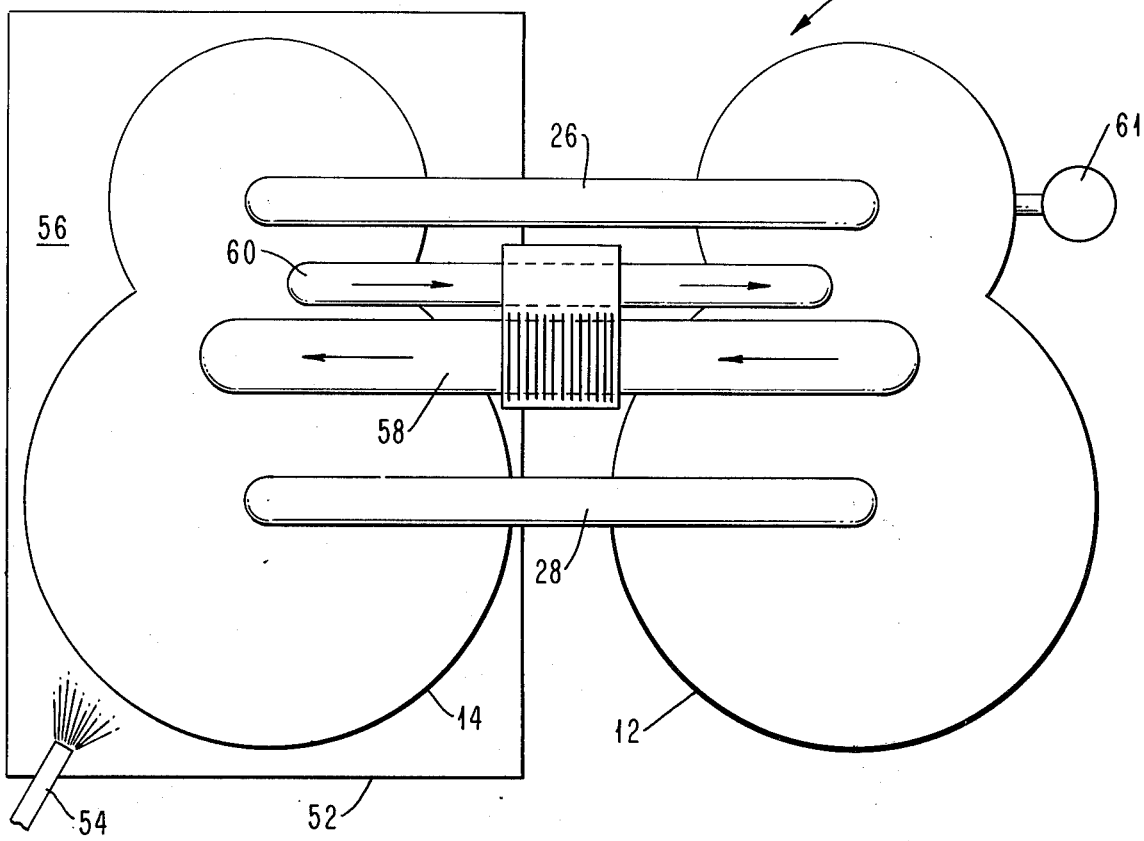
FIG. 19 is a schematic diagram of a Stirling cycle engine embodying the invention.

Referring to FIG. 19, the expander-compressor apparatus can be connected to further components to form a Stirling cycle engine 50. The general construction and operation of such engines are known and FIG. 19 schematically illustrates how the invention can be incorporated therein. Engine 50 comprises a hot section 52 housing EU14 therein. This section includes a conventional nozzel 54 that introduces suitable fuel into a combustion chamber 56 surrounding EU14 and being in an efficient heat transfer relationship therewith. EU14 and CU12 are interconnected by shafts 26 and 28 and operate as described above. The outlet of CU12 is connected by a tube 58 to the inlet of EU14 to deliver compressed fluid thereto, and the outlet of EU14 is connected by tube 60 to the inlet of CU12. A heat exchanger 62 interconnects tubes 58 and 60 whereby heat is transferred from the hotter fluid in 60 to the cooler fluid in 58 and from the fluids in both tubes to the atmosphere or other coolant.

As fuel is continuously injected into and burnt within chamber 56, the heat of combustion thereof causes thermal energy to be transferred through the casing of EU14 into the fluid therein. This raises the energy level of such fluid and allows the energy imparted to shafts 26 and 28 to drive a utilization device 61. The expander-compressor system forms a closed loop and the fluid may be any one of several conventional compressible fluids.

Figure 20:
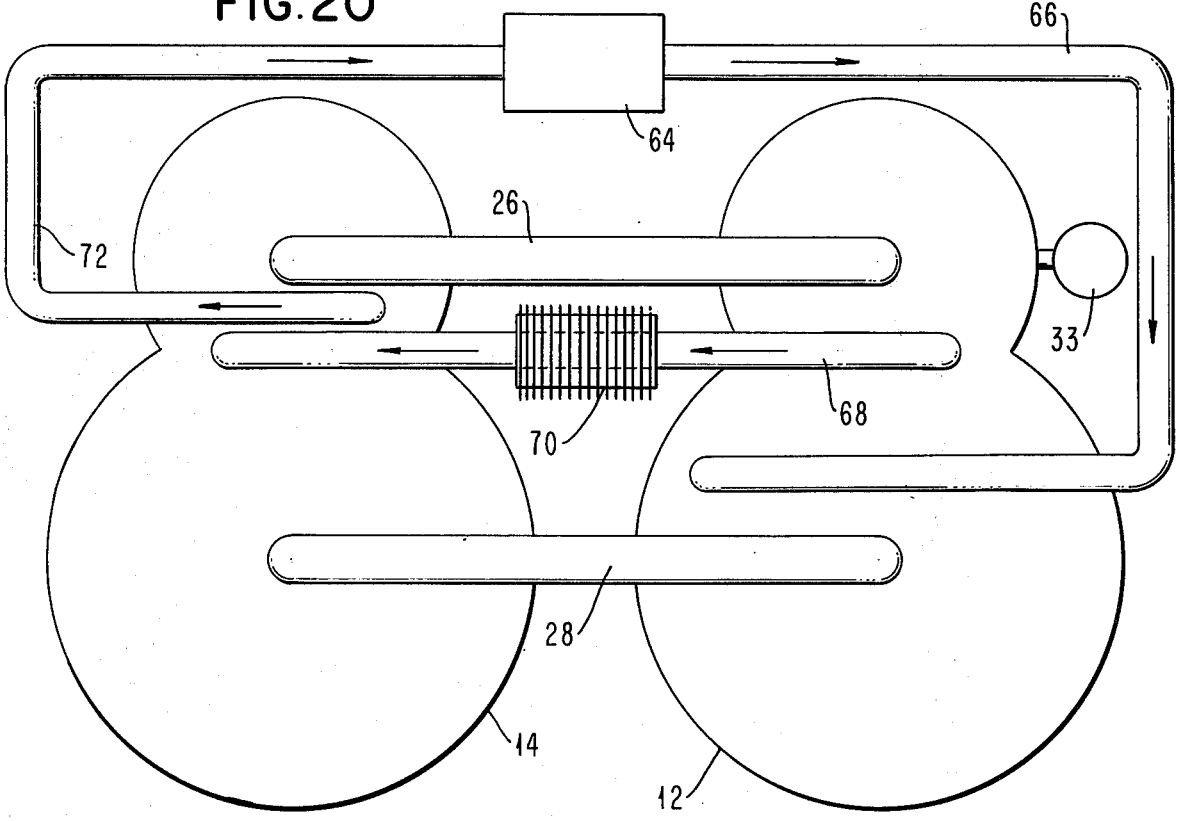
FIG. 20 is a schematic diagram of air cycle refrigeration apparatus embodying the invention.

Referring to FIG. 20, the apparatus can be included in an air cycle air conditioning system for cooling the air in an enclosure 64. In such system, the inlet of CU12 is connected by tube or duct 66 to draw air from enclosure 64. The outlet of CU12 is connected by a duct 68 and heat exchanger 70 to the inlet of EU14. As air is drawn from enclosure 64, it is compressed by CU12 and the compressed air is cooled in exchanger 70. The outlet of EU14 is connected by duct 72 to deliver air that has been further reduced in temperature due to expansion of EU14, to enclosure 64. This cooler air serves to cool the interior of enclosure 64.

Figure 21:
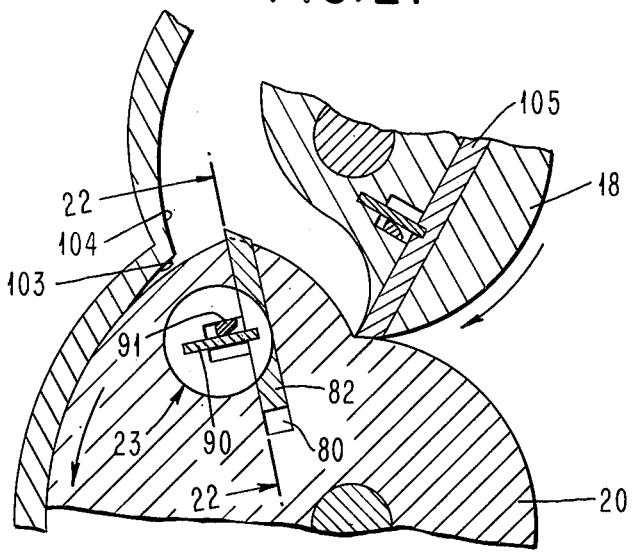
FIG. 21 is an enlarged sectional detail view of a novel apex sealing arrangement, in accordance with the invention, looking through the rotor along reference lines 21—21 of FIG. 22.
Figure 23:
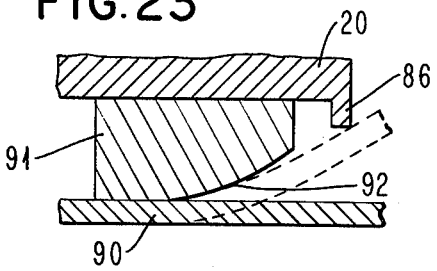
FIG. 23 is a sectional view of a detail within reference circle 23 of FIG. 21, on an enlarged scale relative thereto.
Figure 22:
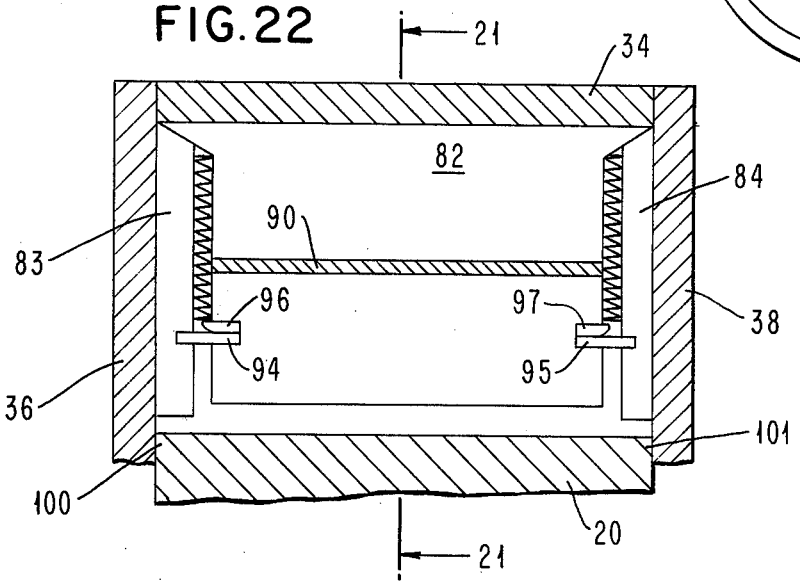
FIG. 22 is an enlarged sectional detail view looking at the rotor along reference line 22—22 of FIG. 21, when engaged with the inner wall of the casing.

It should be appreciated that in connection with rotary devices of the type herein disclosed, it is important to have an effective seal between the casing and the rotors. The above-identified related application discloses one form of suitable seals. FIGS. 21–23 show a novel advantageous arrangement for sealing the rotor apexes. Rotor 20 has a longitudinal slot 80 in which a side wall seal 82 is disposed for engagement with the inner side walls 34 of casing 16. Two end wall seals 83 and 84 radially underlie and seal the ends of seal 82 and slidingly and sealingly engage the inner surfaces of end walls 36 and 38. Seal 82 is radially slideable within slot 80, the outer limit of movement being defined by a stop 86 (FIG. 23) on rotor 20 engageable with a spring 90. Seal 82 is affixed to spring 90 a medial portion of which abuts a face 92 of a fulcrum 91. The shape of face 92 is such as to shorten the effective length of spring 90, as seal 82 moves outwardly under centrifugal force, to thereby shorten the effective length of spring 90 so as to more strongly resist the effect of centrifugal force. Seal 82 and spring 90 are constructed so that the tip of the seal is located inwardly of the inner walls of 34 in the no-deflection state of the spring. The amount of separation is chosen to lessen the forces between the seal and the inner walls so that no contact is made until a predetermined RPM is reached.

Seals 83 and 84 are mounted in groove 80 upon seal 82 by springs 94 and 95. Variable fulcrums 96 and 97 abut springs 94 and 95 and shorten the effective length thereof as outward relative displacement occurs. The outer ends of seals 83 and 84 are beveled and abut the beveled underside of the ends of seal 82, to thereby form an apex to apex seal therebetween. Zig-zag springs 87 and 88 bias seals 83 and 84 into sliding sealing engagement with end walls 36 and 38.

During operations, as rotor 20 moves, seal 82 engages inner wall 34 and rotor 18 and is disengaged therefrom for a period of rotation including the position shown in FIG. 21, wherein seal 82 is able to move outwardly under centrifugal force to a position balanced by the return force of spring 90. As the speed of rotation increases, the return force of spring 90 increases not only due to the greater deflection but also to the shorter fulcrum point or effective length. To prevent chipping or breaking the apex of seal 82, the inner surface of 34 is cut back to form a ramp or cam 103, which decreases in radius in the direction of rotation. Rotor 18 is provided with a similar seal 105 and a cam 104 is formed for the same purpose as cam 103. It should be obvious that the seals are self-compensating in adjusting for wear. While the sealing arrangement is advantageous for the disclosed apparatus, the arrangement is also useful in connection with other forms of rotary devices having similar sealing problems.

Figure 24:
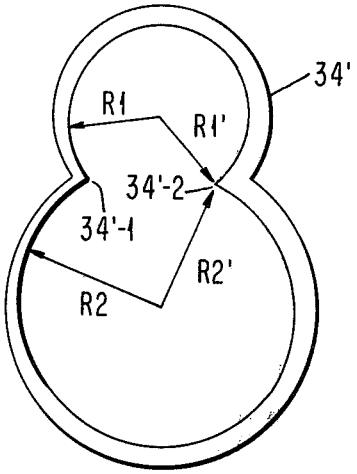
FIG. 24 is a front elevational view of an alternate form of casing side wall.

FIG. 24 shows, on a greatly exaggerated scale, a casing 34' that has been modified to coact with seals 82 and 105 (FIG. 21) to provide a progressively increasing sealing pressure. As shown, the radii R1 and R2 of the inner walls of casing 34' gradually decrease in the direction of rotation towards apex 34'-2 at which point the radii R1' and R2' are about 0.005" smaller or less than R1 and R2. Since, during operation, as rotors 20 and 18 move seals 82 and 105 towards apex 34'-2, the pressure of the compressed fluid increases, the decrease in radii pushes seals 82 and 105 inwardly whereby the forces of the springs 90, upon which the seals are mounted, increases, to provide increased sealing force. The casing of the EU can be similarly modified to decrease the seal forces as the fluid expands.

It should be obvious that changes can be made in the details and arrangement of parts without departing from the scope of the invention as defined in the appended claims.

I claim:

1. In apparatus of the class described, the combination of:

compressor means for compressing fluid comprising
- a first hollow casing having two end walls and a cylindrical side wall forming first and second cylindrical chambers opening into each other and having parallel axes,
- a first inlet extending through one of said end walls for continuously admitting relatively low pressure fluid into said casing,
- a first outlet extending through one of said end walls for exhausting relatively high pressure fluid from said casing,
- and first and second cylindrical rotors mounted in said casing for rotation about axes coaxial with said axes of said chambers;

said first and second rotors each comprising
- an inner portion of a constant radius,
- an outer portion of a constant radius larger than that of said inner portion and substantially equal to that of the chamber in which the rotor is mounted, and volute portions extending between said inner and outer portions, said volute portions having progressively larger radii that constantly increase in size from said inner portion to said outer portion;

said rotors having continuous engagement with each other and with said casing throughout each complete rotation to define an intake region at said inlet for continuously receiving said low pressure fluid and a contractible chamber within which fluid is compressed between volute portions of said rotors which form reaction surfaces, said outlet allowing compressed fluid to flow from said contractible chamber;

expander means for expanding fluid, said expander means being substantially a mirror image of said compressor means in structure and function and comprising
- a second casing,
- a second inlet for receiving relatively high pressure fluid,
- a second outlet for exhausting relatively low pressure expanded fluid,
- and third and fourth rotors defining an exhaust region at said second outlet for continuously exhausting expanded fluid therethrough, said third and fourth rotors further defining an expansible chamber within which fluid from said second inlet is expanded;

means interconnecting all of said rotors for simultaneous synchronous rotation to concurrently compress fluid in said compressor means and expand fluid in said expander means;

means including fluid utilization means connected between said casings for transferring compressed fluid and expanded fluid between said compressor means and said expander means;

seal means mounted on said outer portions of said rotors for rotation therewith, said seal means being sealingly engaged with said casings and the other ones of said rotors during a portion of one complete rotation and disengaged therefrom during another portion of a rotation, said seal means being mounted for sliding movement in a radial direction, and spring means interconnecting said seal means and said rotors and operative to exert forces on said seal means opposing centrifugal forces therein and limiting radially outward movement thereof while disengaged.

2. The combination of claim 1 wherein:

said apparatus is operative as a Stirling cycle engine;

and said fluid utilization means comprises
- a Stirling cycle hot section surrounding said expander means for transferring heat energy into fluid in said expansible chamber,
- said third and fourth rotors forming piston means driven by expansion of fluid in said expansible chamber,
- and heat transfer means for transferring heat out of expanded fluid after it has been exhausted from said second outlet.

3. The combination of claim 1 wherein:

said apparatus is operative as an air cycle refrigeration apparatus for cooling air in an enclosure;
- said last mentioned means comprising heat transfer means for cooling compressed air exhausted from said compressor means and transferring such cooled compressed air to said second inlet,
- air intake means connected between said enclosure and said first inlet for transferring air from said enclosure to said compressor means,
- air outlet means connected between said enclosure and said expander means for delivering air to said enclosure which has been expanded and cooled thereby in said expander means, and motive means for driving said rotors.

4. The combination of claim 1 wherein said seal means comprises:
- a first seal extending longitudinally of said rotor and being engageable with inner side walls of said casing,
- and second and third seals engaged with said first seal and with end walls of said casing.

5. The combination of claim 1 wherein:

said spring means is a cantilever spring having a variable free length, and said combination further includes a fulcrum abutting said cantilever spring and providing a fulcrum point that varies with radial movement of said seal means to control said free length so as to exert greater forces on said seal means due to higher speeds of rotation.

6. The combination of claim 1 wherein:

said casing has inner walls of decreasing radii abutting said seal means and operative to increase forces therebetween in the areas of high pressure within said casing.

7. The combination of claim 1 wherein:

said first and second rotors are shaped whereby the volume of fluid in said contractible chamber is reducible to substantially zero.

8. The combination of claim 7 wherein:

said third and fourth rotors are shaped whereby the volume of fluid in said expansible chamber is initiated from substantially zero volume.

9. The combination of claim 8 wherein:

said third and fourth rotors are operative to expand said expansible chamber from said zero volume before said first and second rotors reduce the fluid in said contractible chamber to said zero volume thereof.

10. The combination of claim 1 wherein:

each of said chambers has a segmentally shaped radial cross-section of constant radius;

said first and second rotors have apexes of substantially the same radii as said first and second chambers and have radially inwardly extending surfaces forming first and second pistons facing in the directions of rotation of said first and second rotors and bounding said contractible chamber;

and said third and fourth rotors have apexes of substantially the same radii as said third and fourth chambers, and have radially inwardly extending surfaces forming third and fourth pistons facing away from the direction of rotation of said third and fourth rotors and bounding said expansible chamber.

11. The combination of claim 10 wherein:

said interconnecting means comprises rotary shaft means connected to said third and fourth rotors, said third and fourth pistons being operative to receive energy from fluid in said expansible chamber and transfer such energy into said shaft means.

* * * * *